US011214981B2

(12) United States Patent
Shi et al.

(10) Patent No.: US 11,214,981 B2
(45) Date of Patent: Jan. 4, 2022

(54) SCREW-DRIVEN CONTROL SYSTEM

(71) Applicant: NANJING KANGNI MECHANICAL & ELECTRICAL CO., LTD., Jiangsu (CN)

(72) Inventors: Xiang Shi, Jiangsu (CN); Hanqing Ge, Jiangsu (CN); Zhibing Gong, Jiangsu (CN); Zuxin Dai, Jiangsu (CN); Songnan Xu, Jiangsu (CN)

(73) Assignee: NANJING KANGNI MECHANICAL & ELECTRICAL CO., LTD., Jiangsu (CN)

( * ) Notice: Subject to any disclaimer, the term of this patent is extended or adjusted under 35 U.S.C. 154(b) by 692 days.

(21) Appl. No.: 16/071,627

(22) PCT Filed: Jan. 28, 2016

(86) PCT No.: PCT/CN2016/072481
§ 371 (c)(1),
(2) Date: Jul. 20, 2018

(87) PCT Pub. No.: WO2017/124579
PCT Pub. Date: Jul. 27, 2017

(65) Prior Publication Data

US 2019/0024408 A1 Jan. 24, 2019

(30) Foreign Application Priority Data

Jan. 22, 2016 (CN) ..... 201610046335.6

(51) Int. Cl.
*E05B 15/04* (2006.01)
*E05B 47/00* (2006.01)
(Continued)

(52) U.S. Cl.
CPC ..... *E05B 15/04* (2013.01); *E05B 47/00* (2013.01); *E05B 47/0012* (2013.01);
(Continued)

(58) Field of Classification Search
CPC ..... E05Y 2900/51; E05Y 2201/22; E05Y 2201/434; E05Y 2201/64; E05Y 2201/702;
(Continued)

(56) References Cited

U.S. PATENT DOCUMENTS 4,198,786 A * 4/1980 Monot ..... B61D 19/02 49/362
5,077,938 A * 1/1992 Moreuil ..... E05F 15/652 49/362

(Continued)

FOREIGN PATENT DOCUMENTS

CN 102395740 3/2012
CN 104533212 4/2015

OTHER PUBLICATIONS

Written Opinion and International Search Report of PCT/CN2016/072481, dated Oct. 12, 2016, 12 pages (English and Chinese).

*Primary Examiner* — Mark A Williams
(74) *Attorney, Agent, or Firm* — Rankin, Hill & Clark LLP

(57) ABSTRACT

A screw-driven control system includes a driving mechanism fixed in a cross beam, a guide locking piece and a limiting mechanism. The driving mechanism includes a screw rod and a motor driven nut assembly having a transmission frame, a nut sleeved in the screw rod, and a follow-up member fixed in the nut; the nut is mounted in the transmission frame, and the transmission frame is connected with a controlled object; the screw rod drives the nut assembly to reciprocate axially along the screw rod.

20 Claims, 5 Drawing Sheets

(51) Int. Cl.

| | |
|---|---|
| ***E05F 15/652*** | (2015.01) |
| ***E05B 81/06*** | (2014.01) |
| ***E05B 81/40*** | (2014.01) |
| ***E05B 83/40*** | (2014.01) |
| *E05F 11/54* | (2006.01) |

(52) U.S. Cl.
CPC ..... *E05B 81/06* (2013.01); *E05B 81/40* (2013.01); *E05B 83/40* (2013.01); *E05F 15/652* (2015.01); *E05B 2015/0479* (2013.01); *E05B 2047/0023* (2013.01); *E05F 11/54* (2013.01); *E05Y 2201/22* (2013.01); *E05Y 2201/232* (2013.01); *E05Y 2201/654* (2013.01); *E05Y 2201/662* (2013.01); *E05Y 2201/676* (2013.01); *E05Y 2900/51* (2013.01)

(58) Field of Classification Search
CPC ..... E05Y 2201/696; E05Y 2900/132; E05Y 2201/244; E05Y 2201/246; E05Y 2900/531; E05Y 2800/11; E05Y 2201/604; E05Y 2201/70; E05Y 2800/112; E05Y 2201/462; E05Y 2201/216; E05Y 2201/43; E05Y 2201/46; E05F 15/652; E05F 15/632; E05F 17/004; E05F 15/622; E05F 15/00; E05F 15/565; E05F 15/603; E05F 15/657; E05F 11/54; E05F 15/57; E05F 15/60; E05F 15/614; E05F 15/668; E05F 15/673; E05F 15/79; E05F 1/1041; E05F 1/105; E05F 1/1066; E05F 2017/005; E05F 11/34; E05B 83/363; E05B 83/40; E05B 47/0012; E05B 2047/0023; E05B 65/0829; E05B 47/00; E05B 81/06; E05B 83/02; E05B 65/08; E05B 65/0823; E05B 65/0847; E05D 15/063; E05D 15/1068; E05D 15/0643; E05D 2015/1071; E05D 15/0626; E05D 15/0652; E05D 15/1044; E05C 2007/007

See application file for complete search history.

(56) References Cited

U.S. PATENT DOCUMENTS

| | | | | |
|---|---|---|---|---|
| 5,148,631 | A * | 9/1992 | Bayard | E05F 15/565 49/370 |
| 6,009,668 | A * | 1/2000 | Reddy | E05C 3/34 49/280 |
| 10,119,319 | B2 * | 11/2018 | Ritt | E05D 15/1068 |
| 2012/0011778 | A1 * | 1/2012 | Kong | E05B 81/00 49/503 |
| 2012/0017517 | A1 * | 1/2012 | Lee | E05B 83/363 49/503 |
| 2012/0073208 | A1 * | 3/2012 | Lee | E05F 15/652 49/449 |
| 2018/0058131 | A1 * | 3/2018 | Lessard | E05B 83/40 |
| 2019/0176856 | A1 * | 6/2019 | Stojc | E05F 15/652 |

* cited by examiner

A–A

SCREW-DRIVEN CONTROL SYSTEM

TECHNICAL FIELD

The present invention relates to the field of automatic control systems, and more particularly, to a screw-driven control system.

BACKGROUND

A screw-driven control system, which is generally a motor-driven screw stem, drives a nut assembly disposed on the screw stem to reciprocate, thereby driving a controlled object connected with the nut assembly. Generally speaking, the screw-driven control system is mostly applied to the field of rail doors and electrically operated doors, and also has locking and unlocking functions. The screw-driven control system, which is generally applied to the above-mentioned fields, locks the nut assembly by an electromagnetic lock, thereby realizing the function of locking the door. For this type of screw-driven control system, the electromagnetic lock must be energized at any time to ensure the door locking stability. If the electromagnetic lock is de-energized, there is a risk when the door is automatically unlocked. However, most of the structures of locking the door by a mechanical lock in the prior art have the problem of complicated structures. As a system mainly composed of mechanical structures, complicated structures will bring problems such as poor reliability, big dead weight, and difficulty in control, and will threaten the personal safe of passengers especially when being applied to public transportation.

SUMMARY

Object of the present invention: the present invention provides a screw-driven control system to solve the problem that the door in the door system using the electromagnetic lock in the prior art is automatically unlocked after being de-energized, and the problems that the door system using the mechanical lock has complicated structure, big dead weight, and difficulty in control.

Technical solutions: in order to solve the foregoing technical problems, the screw-driven control system of the present invention comprises a driving mechanism fixed in a cross beam, a guide locking piece and a limiting mechanism. The driving mechanism comprises a screw rod and a nut assembly driven by a motor; the nut assembly comprises a transmission frame, a nut sleeved in the screw rod, and a follow-up member fixed in the nut; the nut is mounted in the transmission frame, and the transmission frame is connected with a controlled object; the screw rod drives the nut assembly to reciprocate axially along the screw rod; during the forward rotation of the screw rod, when the follow-up member is contacted with the guide locking piece, the follow-up member moves to the limiting mechanism under the guiding of an upper surface of the guide locking piece and is blocked by the limiting mechanism, then the follow-up member rotates with the screw rod to enter a space between a side plane of the guide locking piece and the limiting mechanism and is locked; and when the screw rod rotates reversely, the follow-up member reversely rotates with the screw rod to disengage from the limitation of the guide locking piece and is unlocked, and then moves axially along the screw rod.

Further, the transmission frame has a mechanism for defining a range of angles at which the nut rotates with the screw rod, thereby restricting a large angle of rotation of the follow-up member due to vibration when the nut moves.

Further, the transmission frame has a mounting portion connected with the controlled object, the mounting portion extends upwards to form a nut mounting portion composed of four uprights, the nut is mounted in a space formed by the four uprights, and a limiting pin for defining a range of angles at which the nut rotates with the screw rod is mounted in top ends of the two uprights in a side facing the cross beam.

Further, an outer diameter of the nut is greater than a distance between the uprights at two sides, so the nut is confined in the space between the two uprights. When the nut moves axially along the screw rod, the transmission frame is driven to move together with the nut by applying a thrust to the uprights on different sides.

Further, the nut is composed of an inner ring and an outer ring, the inner ring is threadedly matched with the screw rod, and the outer ring sleeve is sleeved in the inner ring and is matched with the inner ring through an anti-slip gear, and one side of the outer ring facing the cross beam is outwards extended with a mounting base of the follow-up member.

Further, the mounting base has a screw hole, the follow-up member has a screw stem, and the screw stem is screwed into the screw hole to fixedly connect the follow-up member with the nut.

Further, the follow-up member is a roller, and the roller is matched with the guide locking piece to minimize a running resistance of the nut assembly when passing through a surface of the guide locking piece, and improve the system stability.

Further, the two sides of the outer ring of the nut are respectively located between the corresponding adjacent uprights, and the screw rod drives the transmission frame to rotate axially along the screw rod through the outer ring of the nut.

Further, the nut assembly further comprises an elastic member that applies a torsional force to the nut.

Further, the elastic member is a torsion spring, one end of the torsion spring rests on the transmission frame, and the other end of the torsion spring rests on the nut. The torsion spring adopts a model with an inner diameter larger than the diameter of the screw rod and is sleeved outside the screw rod.

Further, the outer ring of the nut is outwards extended with a stopper, and one end of the torsion spring rests on the stopper.

Further, the guide locking piece has a smooth upper surface that guides the follow-up member to move towards a limiting plate.

Further, the guide locking piece has a side plane facing the limiting plate, and a space enabling the follow-up member to fall into is formed between the side plane and the limiting mechanism.

Further, the side plane is an inclined plane that can restrict the follow-up member to pop up.

Further, an included angle between the side plane and a vertical plane is 0 to 10 degrees. In this angle range, the guide locking piece can apply an acting force to the follow-up member without causing the problem of locking the follow-up member due to excessive angle. The angle is 3 degrees preferably.

Further, a slide rail for moving the follow-up member is further provided, the slide rail is connected with the guide locking piece and is in smooth transition with the upper surface of the guide locking piece. The slide rail is arranged to move the follow-up member under the restriction of the slide rail, which can further increase the movement stationarity of the nut assembly.

Further, the limiting mechanism comprises a limiting plate mounted in the cross beam, the limiting plate has a side plane facing the guide locking piece, the side plane and the side plane of the guide locking piece constitute a space enabling the follow-up member to fall into.

Further, the limiting plate is rotatably mounted in the cross beam by a pin shaft, and one side of the limiting plate facing the guide locking piece has a bent vertical plate; and a return spring is arranged between the limiting plate and the pin shaft.

Further, the limiting plate is capable of triggering a signal switch during a rotating motion.

Further, the limiting plate is provided with a waist-shaped hole, a limiting pin is mounted in the cross beam, and the limiting pin extends into the waist-shaped hole to limit angle of rotation of the limiting plate.

Further, the limiting mechanism comprises a manual mechanism that comprises a fixed bracket mounted in the cross beam and a movable bracket mounted in the pin shaft, a return spring is mounted between the two brackets, and the movable bracket is driven to rotate around the pin shaft by a manual pulling rope, and can pull the follow-up member out from the space between the guide locking piece and the limiting plate during rotation.

Further, the movable bracket and the limiting plate are mounted in the same pin shaft. The two do not interfere with each other, and have a high integration degree, which can save the mounting space.

Beneficial effects: according to the screw-driven control system of the present invention, the combination of the nut assembly with the guide locking piece and the limiting mechanism solves the problem of safety risk caused by the automatic unlocking of the electromagnetic lock in the prior art when the electromagnetic lock fails, and is also simpler and more reliable than the existing mechanical lock structure, and the nut assembly is simpler in structure and more stable in operation than the form of being matched with a runner in the prior art. Since the number of members constituting the screw-driven control system is small, the screw-driven control system is easy to machine and has a small dead weight, and does need too much mounting space.

DETAILED DESCRIPTION

Figure 1:
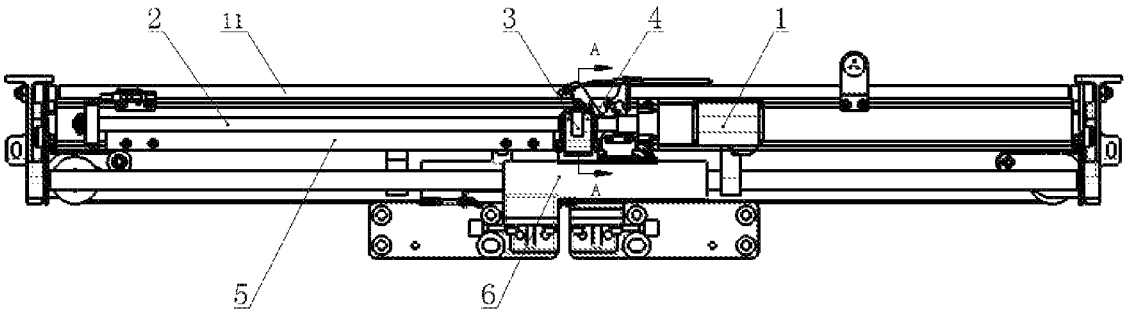
FIG. 1 is a schematic diagram of an overall structure of the present invention.

The invention is further explained with reference to the drawings hereinafter.

FIG. 1 to FIG. 9 show a screw-driven control system which comprises a motor 1 fixed in a cross beam 11, a guide locking piece 51 and a limiting mechanism 4. The motor 1 is connected with a controller; a shaft of the motor 1 is connected with a screw rod 2, and the screw rod 2 is configured with a nut assembly 3 in set; the nut assembly 3 comprises a nut 31 and a follow-up member 7 rigidly connected with the nut 31, the nut 31 and the screw rod 2 constitute a screw motion pair, a transmission frame 9 is mounted outside the nut 31, and the transmission frame 9 and the nut 31 can move relatively. A torsion spring 10 is arranged between the transmission frame 9 and the nut 31, the torsion spring 10 applies a pressure to the follow-up member 7 with the transmission frame 9 as a support, and the transmission frame 9 is connected with a controlled object 6. In specific application, the controlled object 6 can be an electric sliding-plug door or a sliding door of a subway in the field of rail transit, or an electric door in other fields. During the forward rotation of the screw rod 2, the nut 31 is driven to move together with the follow-up member 7; when the nut moves to a position that the follow-up member 7 is contacted with the guide locking piece 51, the follow-up member 7 moves to the limiting mechanism 4 under the guiding of an upper surface of the guide locking piece 51 and is blocked by the limiting mechanism 4, then the follow-up member 7 rotates with the screw rod 2 to enter a space between a side of the guide locking piece 51 and the limiting mechanism 4 and is locked. The screw rod 2 rotates reversely, the follow-up member 7 reversely rotates with the screw rod 2 to disengage from the limitation of the guide locking piece 51 and is unlocked, and then moves axially along the screw rod 2. The guide locking piece 51 has a side plane facing the limiting mechanism 4, and a space enabling the follow-up member 7 to fall into is formed between the side plane and the limiting mechanism 4. The side plane is an inclined plane that can restrict the follow-up member 7 to pop up. An included angle between the side plane and a vertical plane is 0 to 10 degrees. In this angle range, the guide locking piece 51 can apply an acting force to the follow-up member 7 without causing the problem of locking the follow-up member 7 due to excessive angle. The angle is 3 degrees preferably. The transmission frame 9 also has a mechanism for defining a range of angles at which the nut 31 rotates with the screw rod 2. The mechanism is a space, and the follow-up member 7 on the nut 31 moves up and down with the nut 31 in the space, and an upper end and a lower end of the space define a range of rotation of the follow-up member 7, which in turn defines a range of rotation of the nut 31 as moving with the screw rod 2.

Figure 2:
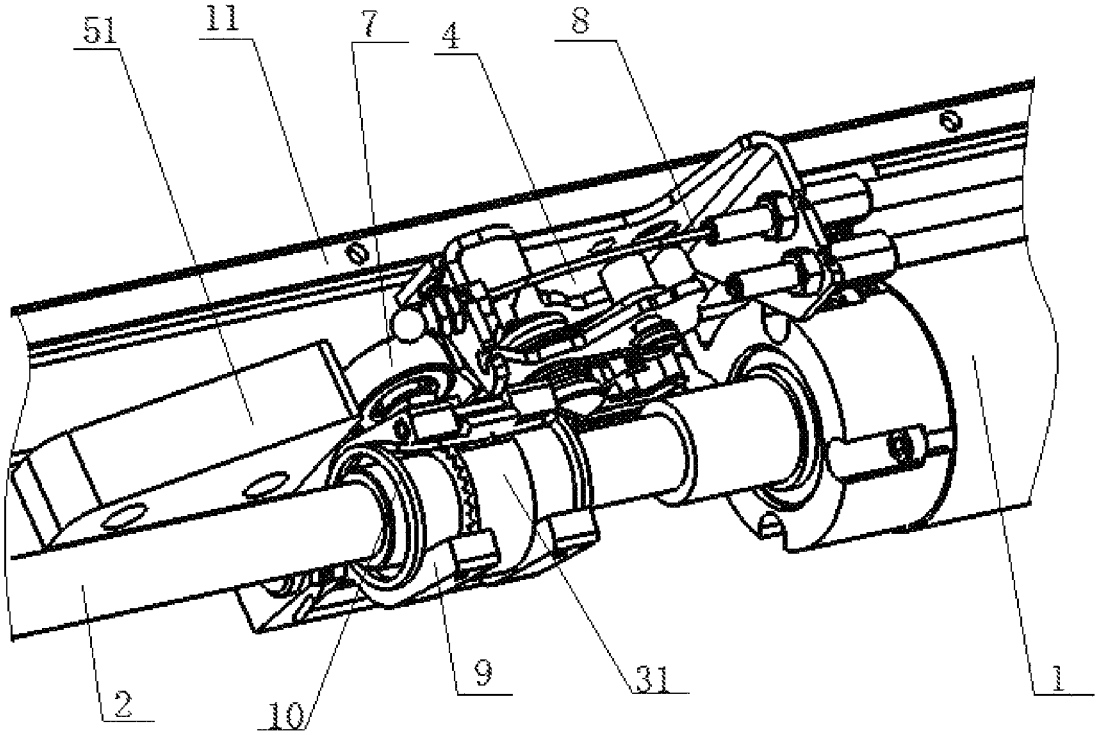
FIG. 2 is a partial schematic diagram of FIG. 1, wherein a guide locking piece is a first implementation manner.

As shown in FIG. 2, as a first embodiment, the guide locking piece 51 has a smooth upper surface that guides the follow-up member 7 to move towards the limiting mechanism 4, and during the movement of the follow-up member 7, when the follow-up member 7 is not contacted with the upper surface of the guide locking piece 51, the follow-up member 7 is in a free state, i.e., at the lower end of the above space for defining the rotation of the follow-up member 7, the torsion spring 10 arranged between the nut 31 and the transmission frame 9 can be set in a relaxed state or small compressed state without applying a torsional force to the nut 31, or applying a small torsional force to the nut 31, so that the nut 31 can be more stable in driving the follow-up member 7 to operate. When the follow-up member 7 passes the upper surface of the guide locking piece 51, the torsion spring 10 is compressed to apply a torsional force to the nut 31, thereby ensuring that the follow-up member 7 can smoothly enter the space between a limiting plate 13 and the guide locking piece 51 after contacting the limiting plate 13 by driving the nut 31 via the rotation of the screw rod 2 and through the torsional force applied by the torsion spring 10.

Figure 3:
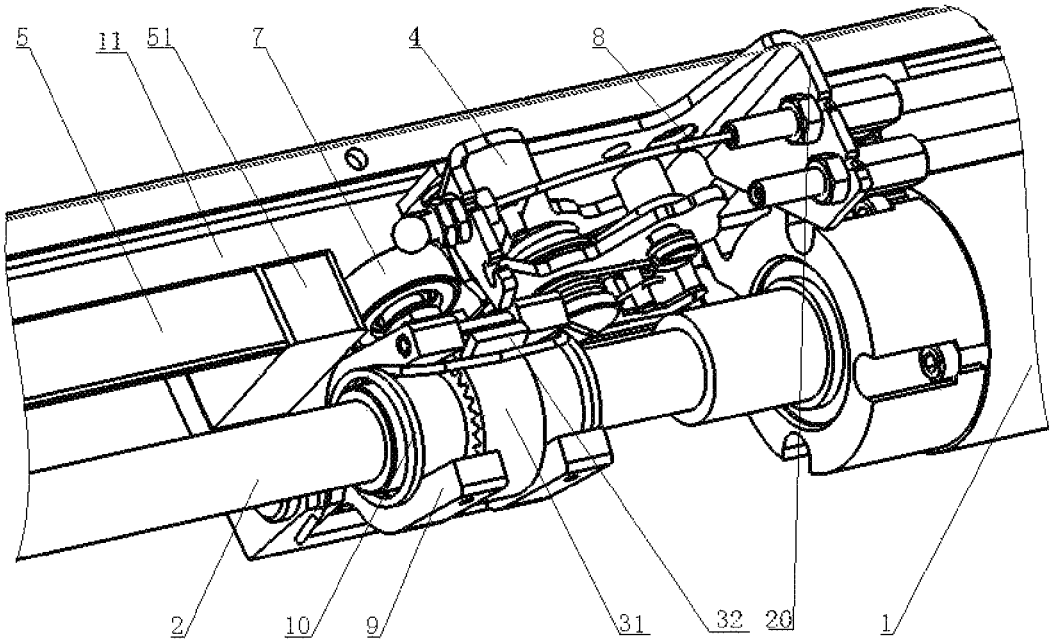
FIG. 3 is a partial schematic diagram of FIG. 1, wherein a guide locking piece is a second manner matched with a slide rail.

As shown in FIG. 3, as a second embodiment, a slide rail 5 for moving the follow-up member 7 is fixedly mounted in the cross beam 11, the slide rail 5 is connected with the guide locking piece 51 and is in smooth transition with the upper surface of the guide locking piece 51. Specifically, the guide locking piece 51 is arranged at one end of the slide rail 5 near a limiting member, and has a horizontal upper surface that is jointed with an upper surface of the slide rail 5 to form an integral horizontal surface. After the slide rail 5 is arranged, the follow-up member 7 is contacted with the upper surface of the guide locking piece 51, and can reciprocate on the upper surface. Under such arrangement, the follow-up member 7 is located between the upper end and the lower end of the above space for defining the rotation of the follow-up member 7, and is not contacted with the upper end or the lower end. At this moment, the torsion spring 10 arranged between the nut 31 and the transmission frame 9 is in a compressed state; when the follow-up member 7 moves to contact with the limiting plate 13, a rotating force of the screw rod 2 to drive the nut 31 by rotation and the torsional force applied by the torsion spring 10 to the nut 31 ensure that the follow-up member 7 can smoothly enter the space between the limiting plate 13 and guide locking piece 51. The slide rail 5 is arranged to move the follow-up member 7 under the restriction of the slide rail 5, which can further increase the movement stationarity of the nut assembly 3.

Figure 4:
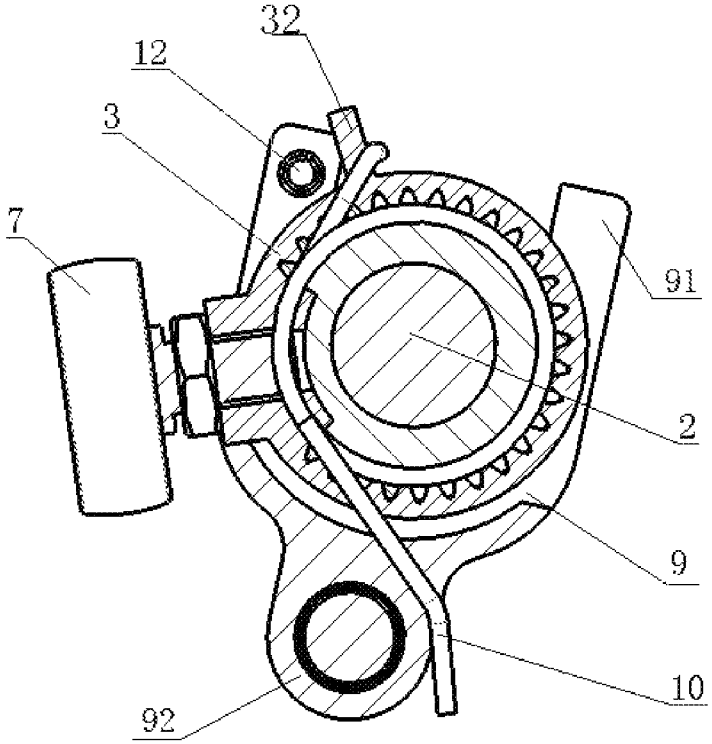
FIG. 4 is an A-A direction schematic diagram of a nut assembly in FIG. 1.
Figure 5:
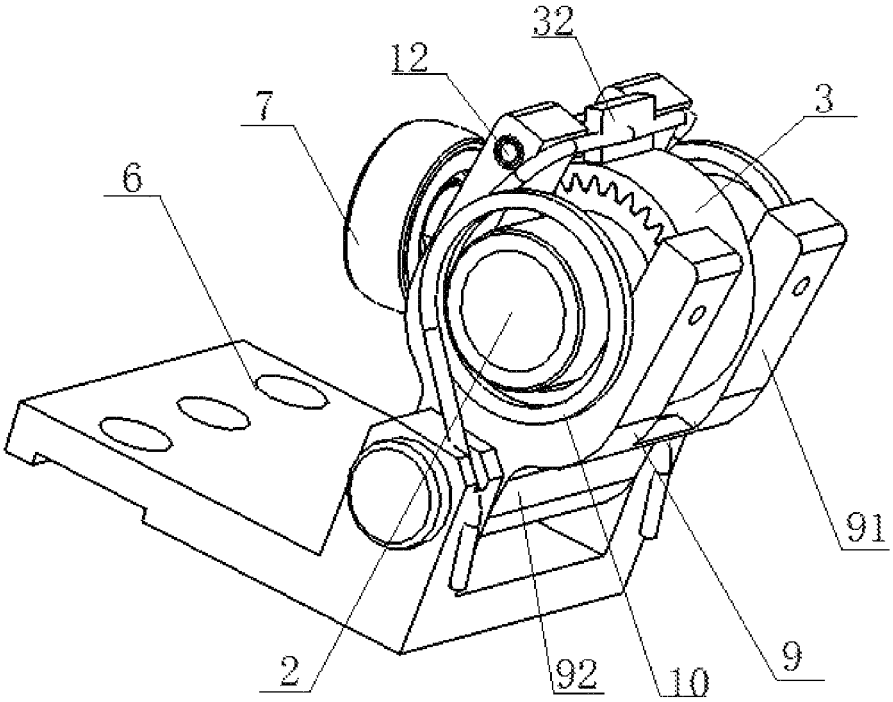
FIG. 5 is a schematic diagram showing a combined structure of a nut assembly and a transmission frame.
Figure 6:
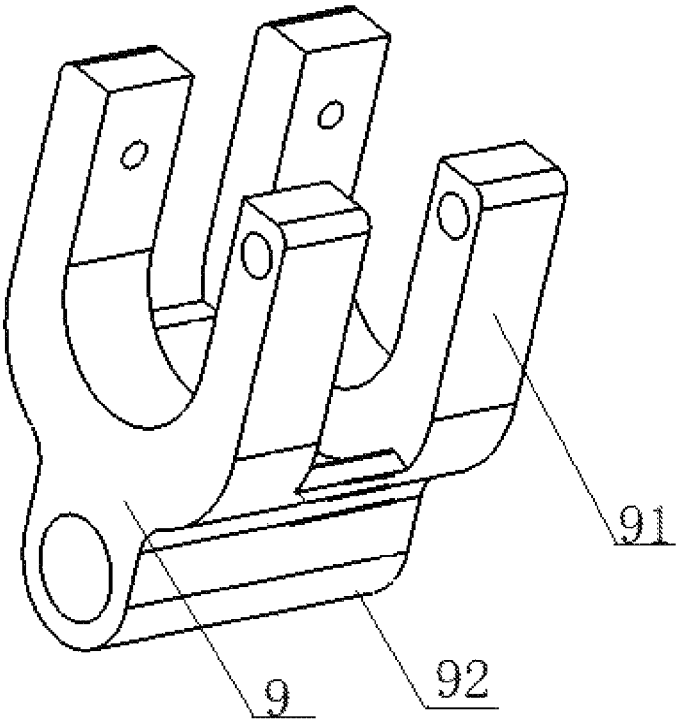
FIG. 6 is a structural schematic diagram of a transmission frame.
Figure 7:
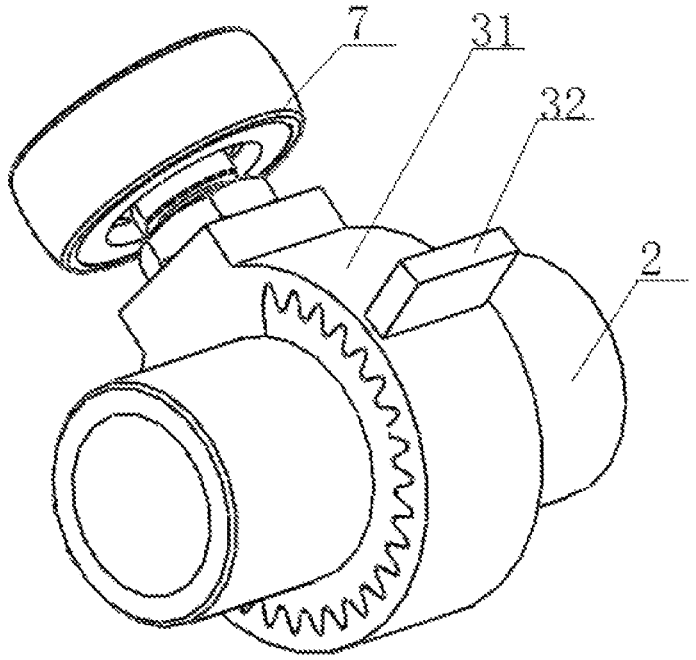
FIG. 7 is a structural schematic diagram of a nut.

As shown in FIG. 4 to FIG. 6, the transmission frame 9 has a mounting portion 91 connected with the controlled object 6, and the mounting portion 91 extends upwards to form a nut mounting portion composed of four uprights 92. The nut 31 is mounted in a space formed by the four uprights 92, and a limiting pin 12 for defining a range of angles at which the nut 31 rotates with the screw rod 2 is mounted in top ends of the two uprights 92 in a side facing the cross beam 11. Therefore, a rotation space of the nut 31 as the screw rod 2 rotates is formed between the limiting pin 12 and the bottom of the two uprights 92 at the side of the cross beam 11. The limiting pin 12 is the above-mentioned upper end, and the bottom of the space between the two uprights 92 is the lower end. An outer diameter of the nut 31 is greater than a distance between the uprights 92 at the two sides, so that the nut 31 is limited in the space between the uprights 92 at the two sides, and when the nut 31 moves axially along the screw rod 2, the transmission frame 9 is driven to rotate together with the nut 31 through applying a thrust to the uprights 92 at different sides. The nut 31 is composed of an inner ring and an outer ring, the inner ring is threadedly matched with the screw rod 2, the outer ring is sleeved in the inner ring and is matched with the inner ring through an anti-slip gear, and one side of the outer ring facing the cross beam 11 is outwards extended with a mounting base of the follow-up member 7. The mounting base has a screw hole, the follow-up member 7 has a screw stem, and the screw stem is screwed into the screw hole to fixedly connect the follow-up member 7 with the nut 31. The follow-up member 7 may be a roller or other type of member having a smooth surface and small running resistance, such as a sliding block having a smooth surface, etc. The roller matched with the guide locking piece 51 can minimize a running resistance of the nut assembly 3 when passing through the surface of the guide locking piece 51, and improve the system stability. The two sides of the outer ring of the nut 31 are respectively located between the corresponding adjacent uprights 92, and the screw rod 2 drives the transmission frame 9 to rotate axially along the screw rod 2 through the outer ring of the nut 31. The nut assembly 3 further comprises a torsion spring 10 that applies a torsional force to the nut 31. One end of the torsion spring rests on the transmission frame 9, and the other end of the torsion spring rests on the nut 31. The torsion spring adopts a model with an inner diameter larger than the diameter of the screw rod 2 and is sleeved outside the screw rod 2. The outer ring of the nut 31 is outwards extended with a stopper 32, and one end of the torsion spring rests on the stopper 32.

Figure 8:
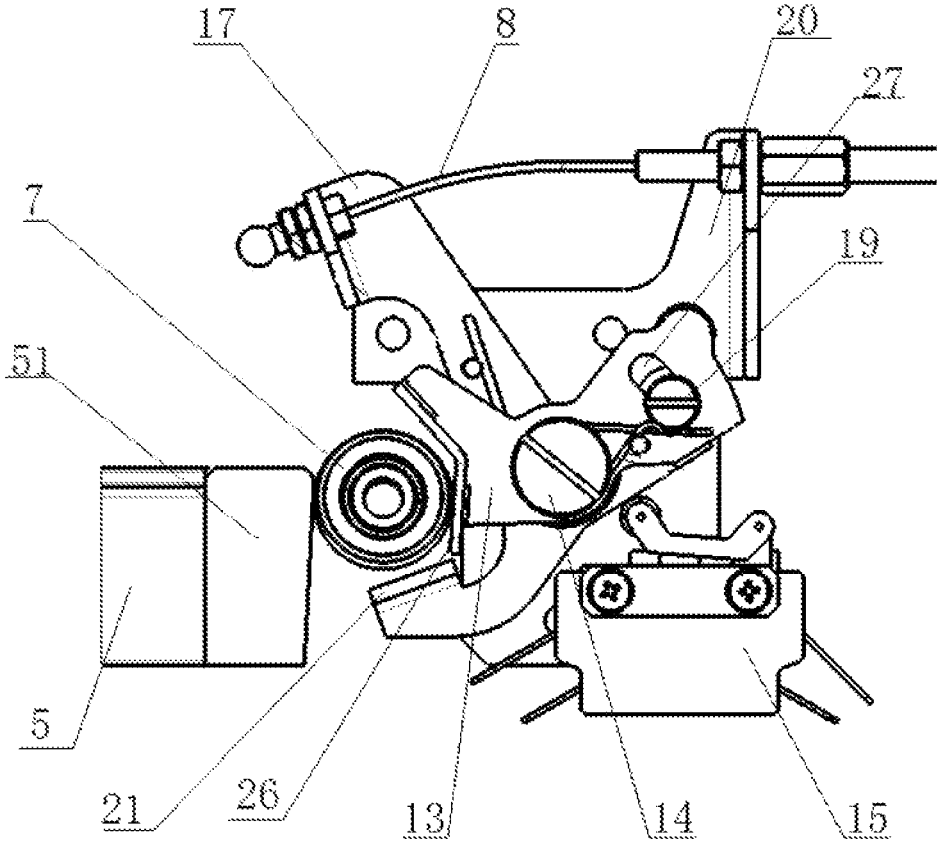
FIG. 8 is a schematic diagram showing a match state of a guide locking piece with a limiting mechanism and a follow-up member.

As shown in FIG. 8, the limiting mechanism 4 comprises a limiting plate 13 mounted in the cross beam 11, the limiting plate 13 has a side plane facing the guide locking piece 51, the side plane and a side plane of the guide locking piece 51 form a space enabling the follow-up member 7 to fall into, the limiting plate 13 is rotatably mounted in the cross beam 11 via a pin shaft 14, one side of the limiting plate 13 facing the guide locking piece 51 has a bent vertical plate 26, and an angle of the vertical plate 26 is correspondingly set according to practical application. Specifically, when the follow-up member 7 is not contacted with the vertical plate 26, an upper half of the bent vertical plate 26 is vertical, and a lower half of the bent vertical plate is bent towards the guide locking piece 51. However, when the follow-up member 7 is contacted with the vertical plate 26, the limiting plate 13 is driven to rotate. When the rotation stops, the lower half becomes the vertical, while the upper half is bent towards the guide locking piece 51, and a bending degree of the vertical plate 26 is determined according to an angle of rotation of the limiting plate 13. If the rotation angle of the limiting plate 13 is a, then tan obtuse angle between the upper half and the lower half of the vertical plate 26 is $180°-\alpha$. A return spring is further arranged between the limiting plate 13 and the pin shaft 14. The return spring may be a torsion spring. The torsion spring is sleeved in the pin shaft 14. One end of the torsion spring is fixed in the limiting plate 13 and the other end of the torsion spring is fixed in the cross beam 11. The limiting plate 13 can trigger a signal switch 15 through an edge thereof during a rotating action, the limiting plate 13 is provided with a waist-shaped hole 27, a limiting pin 19 is mounted in the cross beam 11, and the limiting pin 19 extends into the waist-shaped hole 27 to limit the angle of rotation of the limiting plate 13.

Figure 9:
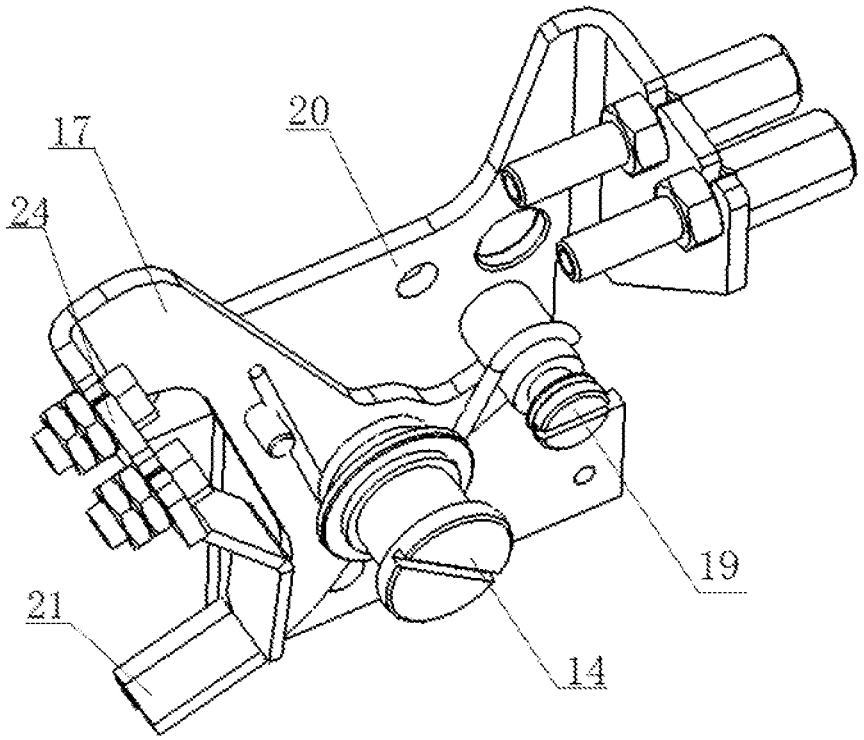
FIG. 9 is a structural schematic diagram of a manual mechanism.

As shown in FIG. 8 and FIG. 9, the limiting mechanism 4 further comprises a manual mechanism that comprises a fixed bracket 20 mounted in the cross beam 11 and a movable bracket 17 mounted in the pin shaft 14. A return spring is mounted between the two brackets, the return spring may be a torsion spring sleeved in the pin shaft 14, one end of the torsion spring is fixed in the fixed bracket 20, and the other end of the torsion spring is fixedly connected with the movable bracket 17. The movable bracket 17 can pull the follow-up member 7 out from the space between the guide locking piece 51 and the limiting mechanism 4 during rotation. Specifically, a bent poking block 21 can be arranged at a lower portion of the movable bracket 17, and the poking block 21 pulls the follow-up member 7 out from the space between the guide locking piece 51 and the limiting mechanism 4 from the lower side of the follow-up member 7. The movable bracket 17 can be driven to rotate around the pin shaft 14 by a manual pulling rope 8. The manual pulling rope is connected with an unlocking switch. The unlocking switch can be a manual knob which can pull the manual pulling rope 8 while rotating. During practical applications, the unlocking switch is actually mounted in a position such as an inner wall of a subway that is easily accessible to people. When the unlocking switch is rotated to drive the movable bracket 17 to rotate with the pin shaft 14 as a center of rotation, the poking block 21 pushes the follow-up member 7 upwards. The movable bracket 17 and the limiting plate 13 are mounted in the same pin shaft 14. The two do not interfere with each other, and have a high integration degree, which can save the mounting space.

The screw-driven control system of the present invention has a compact cooperation between the nut assembly 3 and the guide locking piece 51 and the limiting members, the structure of each member is relatively simple, and is stable during operation and is not easy to fail. Moreover, due to the simple structure, the mass of the entire system can be reduced, and the production cost can be decreased, and the system has a good effect when being applied to fields including rail transit, vehicles and the like in large area.

The screw-driven control system of the present invention can be divided into the following motion processes and states:

1. Electrically locking: the controller sends a signal to the motor 1 to cause the motor 1 to drive the screw rod 2 to rotate, and the screw rod 2 drives the follow-up member 7 to move axially along the screw rod 2 to the limiting mechanism 4 through the nut assembly 3; when the follow-up member 7 is contacted with the guide locking piece 51, the follow-up member moves to the limiting plate 13 under the guiding of the upper surface of the guide locking piece 51 and is blocked by the limiting plate 13. The follow-up member 7 rotates with the screw rod 2 into the space between the side plane of the guide locking piece 51 and the limiting plate 13 and is locked. In the process, the limiting plate 13 rotates to trigger the signal switch 15 arranged under the limiting plate. After the signal switch 15 sends an in-position signal to the controller, the controller controls the motor 1 to stop running and complete locking.

2. Electrically unlocking: the controller sends a signal to the motor 1 to cause the motor 1 to drive the screw rod 2 to rotate reversely, and the follow-up member 7 reversely rotates with the screw rod 2 to disengage from the limitation of the guide locking piece 51 and is unlocked, and disengaged from the limiting plate 13. The limiting plate 13 is returned under the action of the torsion spring to trigger the signal switch 15 to send an unlocking signal to the controller, then the limiting member moves axially along the screw rod 2. When the follow-up member 7 moves to the other end of the screw rod 2, the motor 1 stops running.

3. Manually locking: the controlled object 6 is manually driven to move the nut assembly 3 axially from the screw rod 2 to the limiting mechanism 4. At this moment, the screw rod 2 rotates passively. When the follow-up member 7 is contacted with the guide locking piece 51, the follow-up member moves to the limiting plate 13 under the guiding of the upper surface of the guide locking piece 51 and is blocked by the limiting plate 13. The follow-up member 7 rotates with the screw rod 2 into the space between the side plane of the guide locking piece 51 and the limiting plate 13 and is locked. During this process, the limiting plate 13 rotates to trigger the signal switch 15 arranged under the limiting plate. After the signal switch 15 sends an in-position signal to the controller, the controller controls the motor 1 to stop running and complete locking.

4. Manually unlocking: in a locked state, by rotating the unlocking switch, the manual pulling rope 8 pulls the movable bracket 17 to rotate clockwise around the pin shaft 14, and the poking block 21 of the movable bracket 17 pokes the follow-up member 7 from the lower portion to make the follow-up member 7 leave the locking position, and meanwhile, the torsion spring drives limiting plate 13 to rotate clockwise around the pin shaft 14 and triggers the signal switch 15. After the unlocking switch is released, the movable bracket 17 is driven by the return spring to rotate to the initial position, and then the controlled object 6 is manually driven to move the nut assembly 3 axially from the screw shaft 2 towards a direction away from the limiting mechanism 4 to realize manual unlocking.

The descriptions above are merely preferable embodiments of the invention, and it should be noted that those of ordinary skills in the art may make a plurality of improvements and decorations without departing from the principle of the invention, and these improvements and decorations shall also fall within the protection scope of the invention.

The invention claimed is:

1. A screw-driven control system for an associated door system including an associated sliding door, the screw-driven control system comprising:

a driving mechanism fixed to an associated cross beam defining a support for the screw-driven control system;

a guide locking piece; and a limiting mechanism for limiting movement of the drive mechanism, wherein, the driving mechanism includes:

a screw rod and a nut assembly driven by a motor, the nut assembly includes a transmission frame connected with the associated sliding door, a nut mounted to the transmission frame and connected to the screw rod, and a follow-up member fixed to the nut, wherein the screw rod drives the nut assembly to reciprocate axially along the screw rod, wherein forward rotation of the screw rod rotates the follow-up member with the screw into contact with the an upper surface of the guide locking piece, the upper surface of the guide locking piece moves the follow-up member into contact with the limiting mechanism where the follow-up member is blocked by the limiting mechanism, with the follow-up member blocked by the limiting mechanism the follow-up member rotates with the screw rod to enter a space between a side plane of the guide locking piece and the limiting mechanism and is locked and wherein reverse rotation of the screw rod rotates the follow-up member with the screw rod to disengage from the guide locking piece and is unlocked, and the nut assembly moves axially along the screw rod away from the limiting mechanism, wherein the limiting mechanism includes a limiting plate having a side plane facing the guide locking piece, the side plane of the limiting plate and the side plane of the guide locking piece define the space for the follow-up member.

2. The screw-driven control system according to claim 1, wherein the transmission frame has a mechanism for defining a range of angles at which the nut rotates with the screw rod.

3. The screw-driven control system according to claim 2, wherein the transmission frame has a mounting portion connected with the associated sliding door, the mounting portion extends upwards to form a nut mounting portion composed of four uprights, the nut is mounted in a space formed by the four uprights, and a limiting pin for defining the range of angles at which the nut rotates with the screw rod is mounted in top ends of the two uprights in a side facing the associated cross beam.

4. The screw-driven control system according to claim 3, wherein an outer diameter of the nut is greater than a distance between the uprights at two sides.

5. The screw-driven control system according to claim 3, wherein the nut is composed of an inner ring and an outer ring, the inner ring is threadedly matched with the screw rod, and the outer ring is sleeved in the inner ring and is matched with the inner ring through an anti-slip gear, and one side of the outer ring facing the associated cross beam is outward extended with a mounting base of the follow-up member.

6. The screw-driven control system according to claim 5, wherein the mounting base has a screw hole, the follow-up member has a screw stem, and the screw stem is screwed into the screw hole to fixedly connect the follow-up member with the nut.

7. The screw-driven control system according to claim 1, wherein the follow-up member is a roller.

8. The screw-driven control system according to claim 5, wherein the two sides of the outer ring of the nut are respectively located between the corresponding adjacent uprights, and the screw rod drives the transmission frame to rotate axially along the screw rod through the outer ring of the nut.

9. The screw-driven control system according to claim 1, wherein the nut assembly further comprises an elastic member that applies a torsional force to the nut.

10. The screw-driven control system according to 9, wherein the elastic member is a torsion spring, one end of the torsion spring rests on the transmission frame, and the other end of the torsion spring rests on the nut.

11. The screw-driven control system according to claim 10, wherein an outer ring of the nut is outward extended with a stopper, and one end of the torsion spring rests on the stopper.

12. The screw-driven control system according to claim 1, wherein the upper surface of the guide locking piece is smooth to guide the follow-up member towards the limiting plate of the limiting mechanism.

13. The screw-driven control system according to claim 1, wherein the side plane of the guide locking piece is an inclined plane shaped to restrict the movement of the follow-up member.

14. The screw-driven control system according to claim 13, wherein an included angle between the side plane and a vertical plane is 0 to 10 degrees.

15. The screw-driven control system according to claim 1, further including a slide rail for moving the follow-up member, the slide rail is connected with the guide locking piece and is in smooth transition with the upper surface of the guide locking piece.

16. The screw-driven control system according to claim 1, wherein the limiting plate is rotatably mounted to the associated cross beam by a pin shaft, and one side of the limiting plate facing the guide locking piece has a bent vertical plate, and a return spring is arranged between the limiting plate and the pin shaft.

17. The screw-driven control system according to claim 16, wherein the limiting plate is capable of triggering a signal switch during a rotating motion.

18. The screw-driven control system according to claim 16, wherein the limiting plate is provided with a waist-shaped hole, a limiting pin is mounted in the associated cross beam, and the limiting pin extends into the waist-shaped hole to limit angle of rotation of the limiting plate.

19. The screw-driven control system according to claim 1, wherein the limiting mechanism comprises a manual mechanism that comprises a fixed bracket mounted to the associated cross beam and a movable bracket mounted to the pin shaft, a return spring is mounted between the two brackets, and the movable bracket is driven to rotate around the pin shaft by a manual pulling rope, wherein rotation of the manual plate pulls the follow-up member out from the space between the guide locking piece and the limiting plate.

20. The screw-driven control system according to claim 19, wherein the movable bracket and the limiting plate are mounted to the same pin shaft.

* * * * *